United States Patent [19]

Arens

[11] Patent Number: 4,998,718

[45] Date of Patent: Mar. 12, 1991

[54] SPRING DIVING BOARD SAFETY APPARATUS

[76] Inventor: Jacob Arens, Box 925, Edson, Alberta, Canada, 70E0P0

[21] Appl. No.: 439,159

[22] Filed: Nov. 20, 1989

[51] Int. Cl.[5] ..... A63B 5/10

[52] U.S. Cl. ..... 272/66; 272/71; 272/93; 272/DIG. 4; 434/254; 434/392

[58] Field of Search ..... 272/66, 65, 93, 71, 272/144, DIG. 1, DIG. 4; 434/247, 254, 255, 392; 114/362; 14/69.5, 71.3, 72.5

[56] References Cited

U.S. PATENT DOCUMENTS

| | | | |
|---|---|---|---|
| 2,977,119 | 3/1961 | Lehfeldt et al. | 272/66 |
| 3,030,108 | 4/1962 | Baker | 272/66 |
| 3,178,333 | 4/1965 | Gabrielson | 262/66 X |
| 3,350,094 | 10/1967 | Moss | 272/66 |
| 3,767,193 | 10/1973 | Johnson | 272/66 |
| 3,908,988 | 9/1975 | Avon | 272/66 |
| 4,224,709 | 9/1980 | Alten | 14/71.3 |

FOREIGN PATENT DOCUMENTS

| | | | |
|---|---|---|---|
| 1161869 | 2/1984 | Canada | 272/71 |

*Primary Examiner*—Richard J. Apley
*Assistant Examiner*—Joe H. Cheng
*Attorney, Agent, or Firm*—Leon Gilden

[57] ABSTRACT

A diving board safety apparatus is set forth wherein a "spring type" diving board is provided with a double acting air cylinder actuated by a manually actuatable valve to direct a solenoid valve to selectively extend or retract a telescoping section of the diving board.

1 Claim, 4 Drawing Sheets

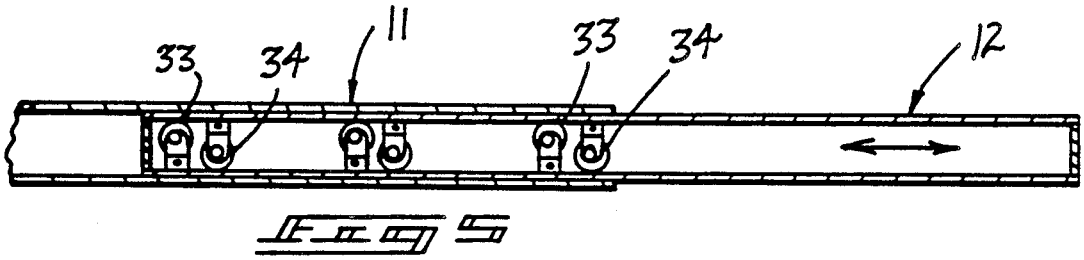
Fig 5
Fig 6
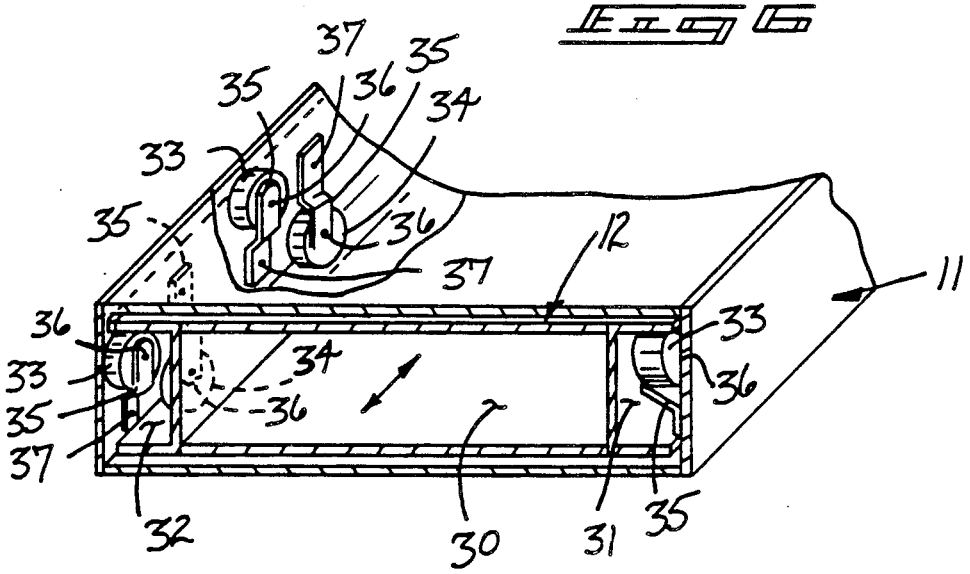

SPRING DIVING BOARD SAFETY APPARATUS

BACKGROUND OF THE INVENTION

1. Field of the Invention

The field of invention relates to spring diving board apparatus, and more particularly pertains to a new and improved spring diving board apparatus for the selective retraction of a telescoping extension of a diving board.

2. Description of the Prior Art

The use of retractable "spring type" diving board apparatus is known in the prior art to accommodate selective retraction of a section of the diving board apparatus for convenience. The instant invention attempts to overcome disadvantages of the prior art apparatus to provide instantaneous retraction of a spring diving board to enable removal of a diving board extension to avoid accidental impact by a diver. Prior art apparatus has provided for retractable diving board apparatus, but it has heretofore failed to provide for the instantaneous retraction utilizing a remote switching arrangement to enable retraction of a diving board apparatus. For example, U.S. Pat. NO. 3,767,193 to Johnson sets forth a diving board apparatus with an extension that may be locked in an extended or retracted position for compactness of organization, as opposed to instantaneous removal of a diving board extension for safety purposes as provided for by the instant invention.

U.S. Pat. No. 3,350,094 to Moss sets forth a mechanically retractable diving board apparatus utilizing a gear arrangement to retract a diving board once a diver has left the board, but utilizes a complex rack and pinion arrangement, as opposed to the instant invention providing for instantaneous pneumatic retraction of a spring diving board extension by utilization of a manually controlled air valve.

U.S. Pat. No. 2,977,119 to Lehfeltd sets forth a diving board apparatus wherein the apparatus may be adjusted for angulation relative to a support surface for the purpose of applying impulse or thrust to the board in addition to that imparted by the natural resiliency of the board utilizing a rack and pinion arrangement based upon a coil spring to provide varying degrees of resiliency to the board.

U.S. Pat. No. 3,030,108 Baker sets forth a diving board organization utilizing a manually manipulated crank to actuate an associated rack and pinion arrangement for retraction of the associated board.

U.S. Pat. No. 3,178,333 to Gabrielsen sets forth a safety mat for securement to a remote end of a diving board to enhance safety of the board to minimize injury due to accidental strikes with the board by a diver.

As such, it may be appreciated that there is a continuing need for a new and improved diving board safety apparatus which addresses both the problems of effectiveness and instantaneous operation, and in this respect the present invention substantially fulfills this need.

SUMMARY OF THE INVENTION

In view of the foregoing disadvantages inherent in the known types of spring diving board apparatus now present in the prior art, the present invention provides a diving board safety apparatus wherein the same compactly and efficiently retracts a diving board extension upon actuation of a double acting air cylinder manually controlled air valve. As such, the general purpose of the present invention, which will be described subsequently in greater detail, is to provide a new and improved diving board safety apparatus which has all the advantages of the prior art diving board apparatus and none of the disadvantages.

To attain this, the present invention comprises a diving board utilizing a telescoping interior member supported by a plurality of opposed rollers cooperating with interior channel portions of the telescoping portion of the diving board. The retractable interior portion of the diving board is pivotally secured to a pneumatic piston rod wherein the pneumatic piston is telescopingly retractable and extensible within a pneumatic cylinder pivotally secured to an outer shell of the board. The double acting air cylinder is operative to instantaneously retract or extend the piston upon pressurizing an associated cylinder. Pressure to the cylinder is derived from an air tank and compressor and directed through a manually controlled air valve to the cylinder actuating the piston either to retract or extend the telescoping portion of the diving board arrangement.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved diving board safety apparatus which has all the advantages of the prior art diving board safety apparatus and none of the disadvantages.

It is another object of the present invention to provide a new and improved diving board safety apparatus which may be easily and efficiently manufactured and marketed.

It is a further object of the present invention to provide a new and improved diving board safety apparatus which is of a durable and reliable construction.

An even further object of the present invention is to provide a new and improved diving board safety apparatus which is susceptible of a low cost of manufacture with regard to both materials and labor, and which accordingly is then susceptible of low prices of sale to the consuming public, thereby making such diving board safety apparatus economically available to the buying public.

Still yet another object of the present invention is to provide a new and improved diving board safety apparatus which provides in the apparatuses and methods of the prior art some of the advantages thereof, while simultaneously overcoming some of the disadvantages normally associated therewith.

Still another object of the present invention is to provide a new and improved diving board safety apparatus wherein the same provides instantaneous retraction of a diving board to eliminate accidental impact by a diver upon leaving the diving board.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an orthographic view taken along the lines 5—5 of FIG. 4 in the direction indicated by the arrows.

FIG. 6 is an isometric illustration of the support rollers cooperating with the telescoping member of the instant invention.

FIG. 7 is a diagrammatical illustration of the pneumatic cylinder and control mechanism of the instant invention.

DESCRIPTION OF THE PREFERRED EMBODIMENT

Figure 1:
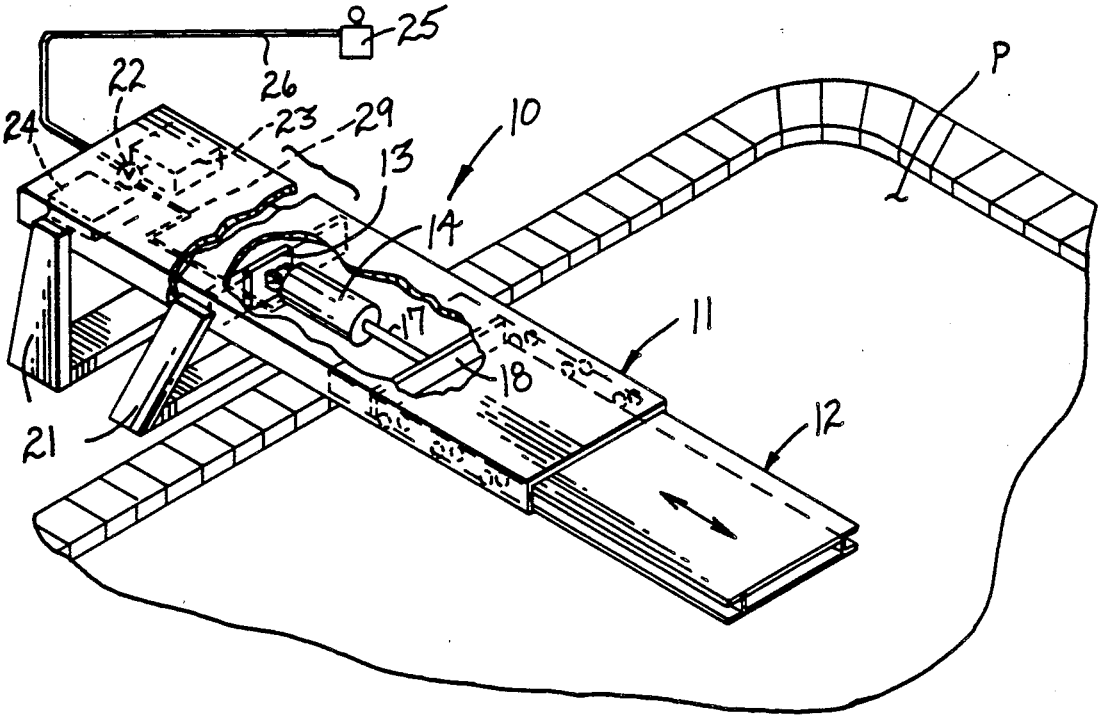
FIG. 1 is an isometric illustration of the instant invention partially cut away to illustrate internal components thereof.
Figure 2:
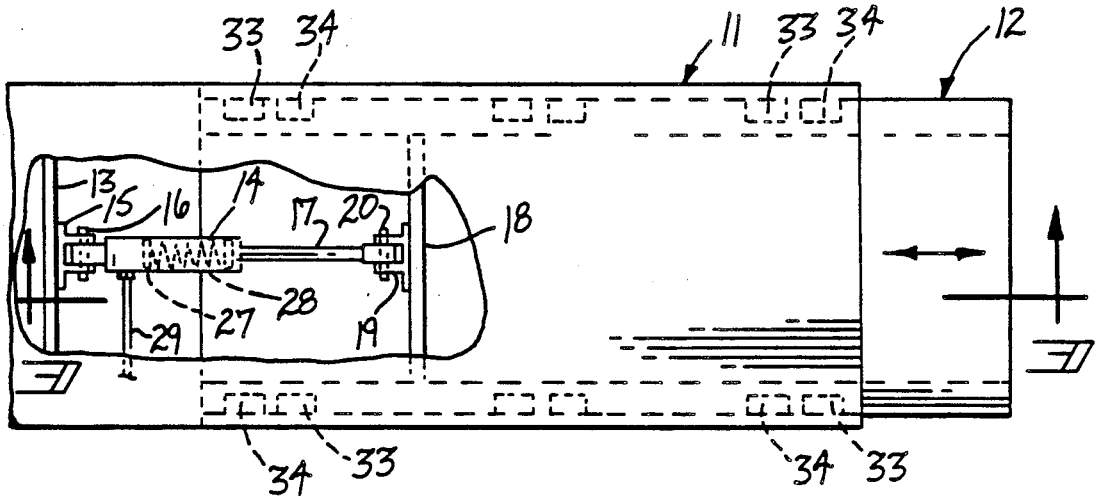
FIG. 2 is a top orthographic view of the instant invention.
Figure 3:
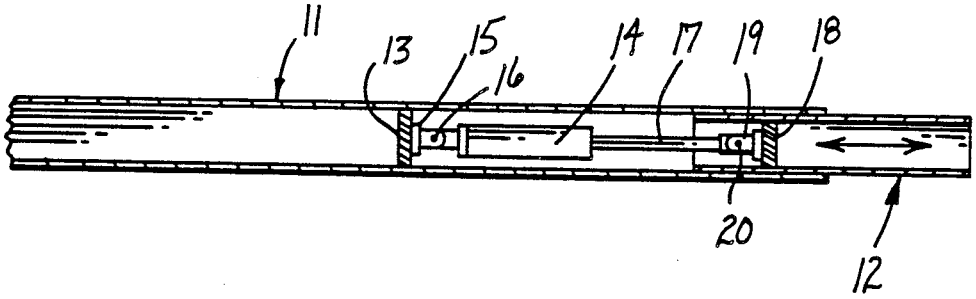
FIG. 3 is an orthographic side view of the instant invention taken along the lines 3—3 of FIG. 2 in the direction indicated by the arrows.
Figure 4:
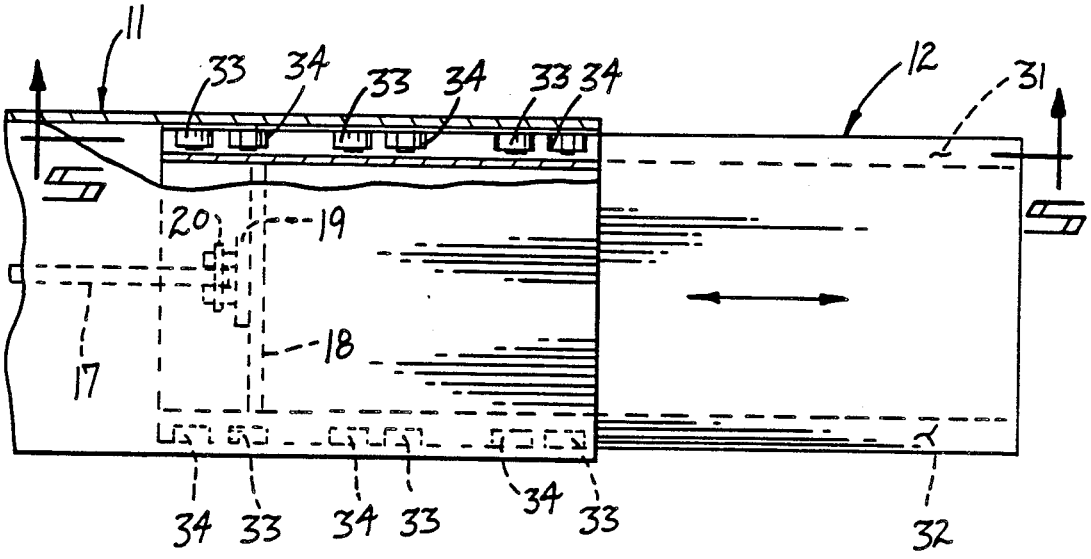
FIG. 4 is a top orthographic view of the instant invention partially cut away to illustrate the support rollers utilized by the instant invention.
Figure 4:
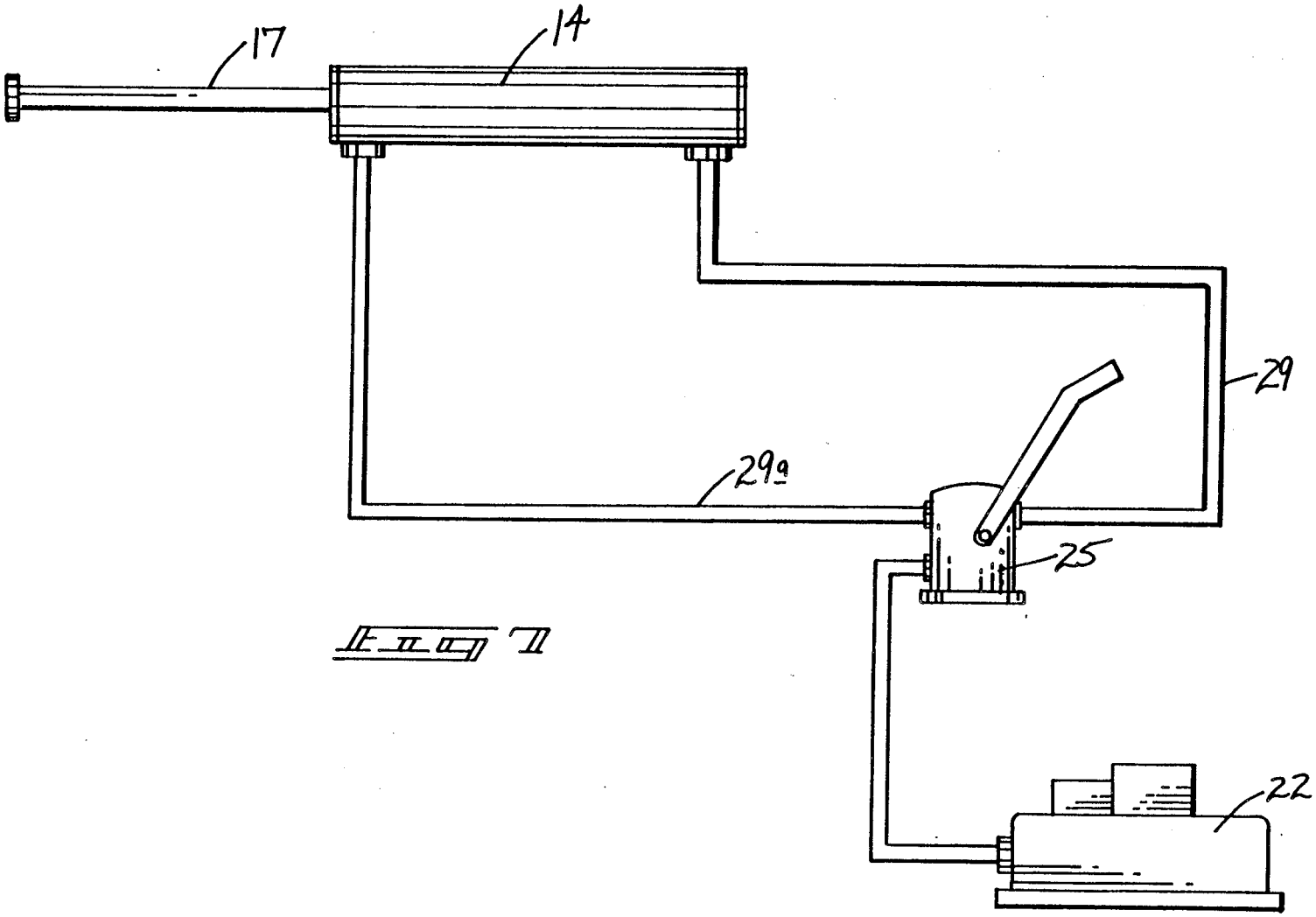

With reference now to the drawings, and in particular to FIGS. 1 to 7 thereof, a new and improved "spring type" diving board safety apparatus embodying the principles and concepts of the present invention and generally designated by the reference numeral 10 will be described.

More specifically, it will be noted that the diving board safety apparatus 10 essentially comprises an elongate hollow housing 11 of generally rectangular cross-sectional configuration telescopingly receiving a diving board extension 12 of an exterior configuration complementary to the hollow interior of the housing 11.

A first rearwardly mounted support brace is integrally secured orthogonally and interiorly to the interior of the elongate hollow housing 11 pivotally mounting a double acting pneumatic actuated cylinder 14 forwardly thereof. A bifurcated first yoke 15 mounts a first pivot pin connector 16 through the yoke and a rearward extension of the cylinder 14. The pneumatic cylinder 14 contains an extensible and retractable piston 17 forwardly and pivotally mounted to a second support brace 18 integrally secured to an interior cavity of the diving board telescoping extension 12 and parallel to the first support brace 13. A second bifurcated yoke 19 is integrally secured to the second brace 18 by a second pivot pin 20 extending through the bifurcated yoke 19 and a forward end of the piston 17.

a plurality of pairs of upwardly extending support brackets 21 are integrally secured to rearward distal portion of the elongate hollow housing 11 rearwardly of the first brace 13. A remotely positioned pneumatic compressor 22 is operative through a manual valve 25 to direct compressed air selectively through flexible pneumatic lines 29 or **29*a* directed to cylinder 14 to extend or retract the piston 17 and the extension 12**.

The piston 17 is formed with a rearward distal piston plate 27 and a forward piston plate 28 to sealingly engage an interior of the cylinder 14 and accept the compressed air directed from valve 25 to a rear or forward portion of the piston to extend or retract the piston and the extension 12 as noted.

The elongate diving board extension 12 is formed with a central elongate cavity 30 and a first and second respective "C" cavity 31 and 32 wherein the central cavity 30 contains the second support brace 18 wherein the first and second "C" cavities 31 and 32 contain a series of upper and lower support rollers 33 and 34 to slidingly and securely guide the extension 12 reciprocatably relative to the housing 11. There are three upper support rollers 33 and three lower support rollers 34 wherein each support roller is maintained in alignment by incorporation of an off-set ("L") shaped bracket 35 overlying each respective support roller. A first end of each off-set ("L") shaped bracket contains an axle 36 mounted and extending through each respective roller, the associated off-set ("L") shaped bracket 35, and a respective side of the hollow housing 11 to secure a respective roller thereto wherein a second distal end of the off-set ("L") shaped bracket contains a bolt 37 extending through the bracket 35 and the housing 11 to stabilize and provide rigidity to the respective axle 36 to maintain each roller of the rollers 33 and 34 in a predetermined position and minimize distortion of a respective roller relative to a "C" cavity of the extension 12. The upper rollers 33 are in rolling engagement with an upper surface of a respective "C" shaped cavity wherein each respective lower roller 35 is in a rolling contact with a lower surface of each "C" shaped cavity to thereby maintain the diving extension 12 in an aligned predetermined orientation relative to the housing 11.

The manner of usage and operation therefore of the instant invention should be apparent from the above description and accordingly no further discussion relative to the manner of usage and operation of the instant invention shall be set forth.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A diving board safety apparatus comprising:

an elongate hollow housing and a diving board extension telescopingly received within said hollow housing and positionable from a first extended position relative to said hollow housing to a second retracted position within said hollow housing, drive means mounted in the hollow housing for removably positioning said diving board extension from said first position to said second position, and manual control means for remotely actuating said drive means, wherein said drive means includes a pneumatic compressor for providing pneumatic pressure to a pneumatic cylinder, said pneumatic cylinder contains a piston extensible and retractable relative to said pneumatic cylinder, and said pneumatic cylinder pivotally mounted to said hollow housing at a rearward end of said pneumatic cylinder, and said piston includes a piston rod pivotally mounted to said diving board extension at a forward end of said pneumatic cylinder, wherein said piston rod includes a piston plate orthogonally and pivotally mounted interiorly of said diving board extension, a cylinder plate orthogonally and pivotally mounted to said pneumatic cylinder and also mounted interiorly of said hollow housing, wherein said diving board extension includes an elongate central chamber and C-shaped channel side chambers, and the hollow housing includes a plurality of upper and lower roller means mounted on each interior side of said hollow housing to guidingly associate with each C-shaped chamber to maintain said diving board extension in an aligned position relative to said hollow housing, wherein said plurality of upper and lower roller means includes a plurality of upper rollers, a plurality of lower rollers, and wherein each of said plurality of upper and lower roller means includes an off-set L-shaped bracket, one end of said off-set L-shaped bracket having an axle and a respective roller rotatably mounted through said axle, and a further end of said off-set L-shaped bracket is fixedly secured to a respective interior side wall of said hollow housing.

* * * * *